United States Patent [19]

van Breda et al.

[11] Patent Number: 4,711,704

[45] Date of Patent: Dec. 8, 1987

[54] METHOD OF TINNING METAL STRIP

[75] Inventors: Jacques van Breda, Hillegom; Cornelis Pronk, Castricum, both of Netherlands

[73] Assignee: Hoogovens Groep B.V., Ijmuiden, Netherlands

[21] Appl. No.: 15,386

[22] Filed: Feb. 17, 1987

[30] Foreign Application Priority Data

Feb. 18, 1986 [NL] Netherlands ..... 8600404

[51] Int. Cl.[4] ..... C25D 7/06

[52] U.S. Cl. ..... 204/28

[58] Field of Search ..... 204/28

[56] References Cited

U.S. PATENT DOCUMENTS 2,895,888 7/1959 Varner ..... 204/28

4,240,881 12/1980 Stanya ..... 204/28

*Primary Examiner*—T. M. Tufariello

*Attorney, Agent, or Firm*—Stevens, Davis, Miller & Mosher

[57] ABSTRACT

Electrolytic tinning is performed in a tinning line having a series of tinning tanks through which metal strip moves while electrolyzing current is passed, and having at at least one of the entry side and the exit side at least one buffer apparatus for storing a variable amount of the moving strip. In order that some speed variation in the tinning tanks can occur, allowing the use of lower capacity buffer apparatuses, the current passing in each tinning tank is adjusted during tinning for portions of the strip. The current is calculated for a given strip portion by (a) determination of a value for the thickness of the tin layer on entry to the tinning tank;

(b) determination of a value for the desired thickness on exit from the tinning tank;

(c) from the difference of these values determination of a value g for the desired increase in the tin layer thickness in the tinning tank; and (d) determination of the instantaneous required value of the current I in the tinning tank in dependence on the value g and the speed v of the strip through the tank.

12 Claims, 3 Drawing Figures

METHOD OF TINNING METAL STRIP

BACKGROUND OF THE INVENTION

1. Field of the Invention

The invention relates to a method of electrolytic tinning of a metal strip in a tinning line having a plurality of tinning tanks through which the strip moves in series while electrolysing current is passed, and having at at least one of the entry side and the exit side of the series of tinning tanks at least one buffer apparatus for storing a variable amount of the moving strip so that the strip speed in the tinning tanks can be temporarily different from the strip speed at the line entry or exit. Typically, such a buffer apparatus is a looping pit or a looping tower.

2. Description of the Prior Art

Tinning is generally used in the iron and steel industry to coat cold rolled steel strip with a layer of tin on one or both sides. In electrolytic tinning, a metal strip is fed through tinning tanks which are filled with an electrolyte. By passing a current through the electrolyte, the tin anodes, which hang in the electrolyte, go into solution at least partially and replace the material in solution which deposits on the metal strip which acts as cathode.

In such tinning lines there are entry and exit buffer apparatuses for the moving strip which are intended to achieve the result that disturbances in the entry and exit speeds of the strip are not reflected in corresponding changes of speed through the tinning tanks. Such changes in the throughput speed in the tanks are directly reflected in the tin deposit obtained on the metal strip. Further processing of the metal strip involves difficulties in that the tin deposit displays too great deviations from the desired value.

The tinned metal strip is mostly used for the production of tin cans, in which the deposited tin has two functions, namely first a lubricating property during the production phase of cans when the walls are stretched, and second a protective effect between the base material of the metal strip and the contents of the can. The tooling for the stretching of the walls is so adapted that a certain thickness of tin deposit is required for the proper working of the tools. Deviations in thickness can lead to the wall stretching machine seizing and even damage to the dies. These problems can be overcome by the buffer apparatuses at the entry and exit side of the tinning line so that the strip speed through the tinning tanks can be held constant in the face of the variation occurring in the entry and exit speeds of the metal strip. These variations stem from the necessity to connect a new metal strip at the entry side and to divide the strip at the exit side, both of which may be done on stationary strip e.g. at the entry side at a welding machine.

The buffer apparatuses used for this, e.g. looping pits or looping towers, require very high investment costs, which are strongly dependent upon the size of the buffer apparatus.

In the past adjustment of the total current through all the tinning tanks has been tried as a method of compensating to some extent for the variations in the speed of the metal strip through the tinning tanks, so that smaller buffer apparatuses could be used. However, it remains true that with this method the so-called over-plating and under-plating still occurs. This means that localised variations in the tin deposit occur, and these regions are not usable on quality grounds. This leads to the rejection of long pieces of metal strip.

Such variations in tin deposits appear to have a proportionally greater influence on the quality of the tinned product, as the desired quantity of deposited tin is smaller.

The market for tin cans has recently, with a view to cost reduction, seemed to have a tendency towards lower quantities of deposited tin. This is illustrated in that the usual quantity of tin deposited up to recently was 6 $g/m^2$, and the forecast for the decade from 1990 is for a quantity of deposited tin of 1 $g/m^2$.

The urge to develop a method in which a qualitatively good product can be made and guaranteed using a plant with buffer apparatuses of limited storage capacity, and therefore lower cost, is thus continually greater.

SUMMARY OF THE INVENTION

The object of the present invention is at least partly to solve the above problem, in particular to permit reduction of the size of the strip buffer apparatuses in a tinning line.

The invention is characterised in that the current passing in each tinning tank is adjusted during tinning for portions of the strip in accordance with its determination by the following steps:

(a) determination of a value for the thickness of the tin layer on the strip portion as it enter the tinning tank;

(b) determination of a value for the desired thickness of the tin layer on the strip portion as it leaves the tinning tank;

(c) from the difference of the values determined in steps (a) and (b), determination of a value g for the desired increase in the tin layer thickness on the strip portion in the tinning tank; and (d) determination of the instantaneous required value of the current I in the tinning tank for the portion of the strip in dependence on the value g from step (c) and the instantaneous speed v of the strip through the tank.

Preferably in step (d) the current value I is determined according to the formula $$I=g.w.v/e.r$$

in which w is the strip width, e is an electrolytic constant and r is the current deposition ratio.

In the practice of this invention, tinning tanks may be grouped, for the calculation of a single value of the instantaneous current required in all members of the group; from the point of view of the invention, the whole group can in that case be considered as a single tank. It is preferred however that the required instantaneous current value is calculated for each tank individually.

By this invention, the desired advantage is obtained that small buffer apparatuses at the entry and exit side of the tinning line can be employed, because the adjustment of current for each strip portion achieves high accuracy of tinning thickness. Consequently, a tinning plant that delivers qualitatively good plate can be built for a low investment.

Preferably in step (a) the said thickness value is taken as zero for the first tinning tank in the series and for each subsequent tank is determined by the following steps:

(a)(i) determination of a value for the thickness of the tin layer on the entry of the strip portion into the preceding tank in the series;

(ii) determination of a value for the average current Igem in the said preceding tank during transit of the strip portion through the said preceding tank;

(iii) determination of a value for the thickness increase g' on the strip portion in the said preceding tank from the values determined in steps (i) and (ii); and (iv) determination of the thickness value at entry to the subsequent tank from the values determined in steps (i) and (iii). In this suitably in step (a)(iii) the value g' is determined according to the formula $$g' = r.e.I_{gem}/w.v'$$

where v' is the instantaneous strip speed for the portion in the said preceding tank.

This has the advantage that a quick and simple measurement of the thickness of the tin layer on the portions of the metal strip between the tinning tanks is realised.

Preferably the desired thickness of the tin layer on leaving the tinning tank is set by dividing the thickness of the tin layer desired on the metal strip on exit from the tinning line, evenly among the tinning tanks in which it is tinned. This has the advantage that optimal controllability is present in each tinning tank used, in which deviations in the thickness required for the tin deposit on the egress from a defined tinning tank can be corrected in the tinning tanks subsequently used.

Preferably as far as possible the speed of the metal strip in the tinning tanks is set so high that the current in at least one of the tinning tanks attains a maximum permitted value. By this the processing level of the tinning line is used to the greatest possible extent.

Preferably the said current-deposition ratio r is increased or decreased as the thickness of the tin layer on the metal strip at the exit of the tinning line is greater or smaller respectively than the thickness desired at the exit to the tinning line. By this, changes in the process conditions which cause the quantity of tin deposited per unit surface area not to correspond with the current fed to the tinning tanks are simply and automatically corrected.

BRIEF INTRODUCTION OF THE DRAWINGS

A preferred embodiment of the invention will now be described by way of non-limitative example with reference to the accompanying drawings, in which.

DESCRIPTION OF THE PREFERRED EMBODIMENT

Figure 1:
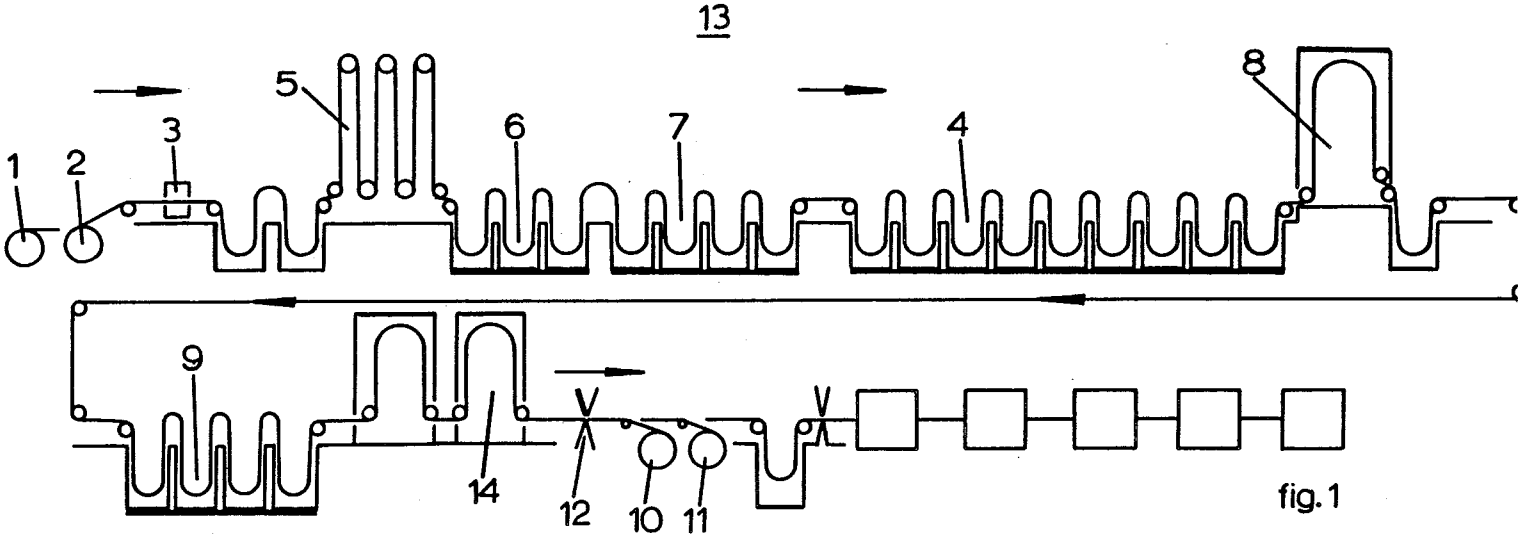
FIG. 1 is an overall view of a tinning plant with a tinning line to which the invention is applicable.

Referring to the Figures, a coil to be tinned is unwound at a decoiler 1 or 2, and to provide a continuous strip each new coil is welded onto its predecessor by the welding machine 3. At the moment of welding, the metal strip from the coil must be stationary. To make this possible, without interrupting the tinning process further down the tinning line 4, material travelling through from the preceding coil is meanwhile stored in buffering looping towers 5. The looped material which can be stored in the looping towers 5 in this embodiment is, because of the limited size of the looping towers permitted by the present invention, insufficient for the weld to be made from the old to the new coils without reducing the speed of the material in the tinning tanks.

After passing through the looping towers 5, the strip passes through a degreasing unit and a pickling unit, which are necessary for good adhesion of the tin deposited in the series of tinning tanks 4. Further improvements to quality are made after tinning by heating in the melting plant 8 and by a chemical post-treatment in plant 9. A tin layer measuring device 14 follows.

Thereafter the metal strip is rewound into coils at coilers 10, 11. When a coil has the required size, the metal strip can be cut with shears 12 and the metal strip is fed to the free one of the coiler 10 or 11. If desired, there may be a set of looping towers (not shown) similar to the tower 5, between the measuring device 14 and the shears 12.

Figure 3:
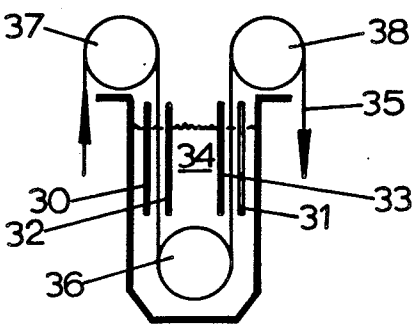
FIG. 3 shows a tinning tank of the tinning line.
Figure 2:
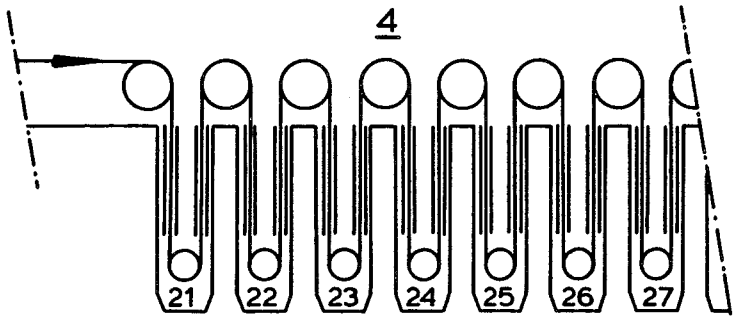
FIG. 2 shows part of the tinning line of FIG. 1, which consists of a number of tinning tanks in series.

In FIG. 2 seven tanks 21–27 of the tinning line 4 are shown. One tinning tank 22 is shown in FIG. 3.

In each of the tinning tanks 21–27 there are four anodes, two on the upper side of the metal strip and two on the lower side. In the tinning tank 22, these are anodes 30, 31 on the lower side and anodes 32, 33 on the upper side. These anodes are connected to the positive pole of a rectifier circuit. The material from which the anodes are made is tin.

On passing an electric current through the anodes, the anode material partially passes into solution in the electrolyte 34 in which the anodes hang. The current is maintained so that the tin ions move away from the anodes to the metal strip, and are subsequently deposited thereon. A layer of tin is thus formed on the strip.

The metal strip 35 is fed through the series of tinning tanks 21–27 via rollers, for example the rollers 36, 37 and 38 in the case of the tinning tank 22.

The length of metal strip between the roller 36 in the tinning tank 22 and the rollers 37, 38 above it being known, this known length is used to calculate the residence time of a part of the metal strip 35 in the tinning tank, given the throughput speed of the metal strip 35. This residence time serves for the synchronisation of the starting time for which a fresh setting for the current in each tinning tank is calculated.

In this calculation, first a determination is made of the thickness of the tin deposit on the metal strip 35 as it leaves the preceding tinning tank, for example tinning tank 21. The metal strip 35 entered tinning tank 21, which is the first, without any tin deposit. The tin deposit on a portion of the metal strip 35 on leaving tinning tank 21 is related to the average tinning current Igem between the two moments of synchronisation.

The tin deposit g' on the portion of the metal strip 35 on leaving the tinning tank 21 is given by $g' = r.e.I_{gem}/w.v'$, where r = current-deposition ratio e = electrolytic constant w = width of the metal strip v' = throughput speed of the metal strip in the tank 21.

The expected increase of tin deposit g on the portion of metal strip 35 from the tinning tank 22 (which is calculated from the present value of the current in the tank 22 and the speed v in the tank 22, from the formula $I = g.w.v/e.r$) is continually compared with the calculated desired tin deposit $g_{gew}$ in the tank 22, this being derived from the value g' given above for the strip portion and from a desired total thickness at the exit from the tank 22. From this comparison an adjustment I in the current to be passed through tinning tank 22 while the metal strip portion is passing through is ascertained according to the formula $\Delta I = (g_{gew} - g).w.v./e.r.$ The determination of the current in the remaining tinning tanks as well as the determination of the tin deposit on leaving any one of the remaining tinning tanks is mutatis mutandis done in the same way.

The desired tin deposit on the exit side of a tinning tank 21–27 is ascertained from a calculated build-up of the tin deposit to a desired final value in equal steps, spread over the tinning tanks 21–27.

The throughput speed of the metal strip 35 is preferably set so high that at least one of the currents in the tinning tanks 21–27 is at the maximum allowable value. By using a measuring device 14 the tin deposit actually achieved can be compared with the desired value; from the deviations established the current-deposition ratio r that was employed for the calculations can be adjusted. This is done by increasing r when the exit thickness is too great and decreasing r when the exit thickness is too small.

The design of the required measuring devices for strip speed and current, and the control means for performing the required calculations and adjusting the current in each tank need not be described in detail, since they will be apparent to the skilled man.

To give some numerical examples, a tinning line as described above consisting of seven tinning tanks was used for tinning to desired thicknesses of 2.0 to 6.0 $g/m^2$. In two examples the speeds of the metal strip used varied between 4 to 6 m/s and vice versa, and from 2 to 6 m/s and vice versa respectively. The deceleration and acceleration rate amounted to 0.11 $m/s^2$ in each case. The deviations in the thickness of the tin deposit in these two cases were at all times equal to or smaller than 0.03 $g/m^2$.

What is claimed is:

1. A method of electrolytic tinning of a metal strip in a tinning line having a plurality of tinning tanks through which the strip moves in series while electrolysing current is passed, and having at at least one of the entry side and the exit side of the series of tinning tanks at least one buffer apparatus for storing a variable amount of the moving strip so that the strip speed in the tinning tanks can be temporarily different from the strip speed at the line entry or exit, the method being characterised in that the current passing in each tinning tank is adjusted during tinning for portions of the strip in accordance with its determination by the following steps:

(a) determination of a value for the thickness of the tin layer on the strip portion as it enter the tinning tank;

(b) determination of a value for the desired thickness of the tin layer on the strip portion as it leaves the tinning tank;

(c) from the difference of the values determined in steps (a) and (b), determination of a value g for the desired increase in the tin layer thickness on the strip portion in the tinning tank; and (d) determination of the instantaneous required value of the current I in the tinning tank for the portion of the strip in dependence on the value g from step (c) and the instantaneous speed v of the strip through the tank.

2. A method according to claim 1 wherein in step (d) the current value I is determined according to the formula $$I = g.w.v/e.r$$

in which w is the strip width, e is an electrolytic constant and r is the current deposition ratio.

3. A method according to claim 1 wherein in step (a) the said thickness value is taken as zero for the first tinning tank in the series and for each subsequent tank is determined by the following steps:

(a)(i) determination of a value for the thickness of the tin layer on the entry of the strip portion into the preceding tank in the series;

(ii) determination of a value for the average current Igem in the said preceding tank during transit of the strip portion through the said preceding tank;

(iii) determination of a value for the thickness increase g′ on the strip portion in the said preceding tank from the values determined in steps (i) and (ii); and (iv) determination of the thickness value at entry to the subsequent tank from the values determined in steps (i) and (iii).

4. A method according to claim 3 wherein in step (a)(iii) the value g′ is determined according to the formula $$g' = r.e.I_{gem}/w.v'$$

where v′ is the instantaneous strip speed for the portion in the said preceding tank.

5. A method according to claim 1 wherein the thickness value of step (b) is determined by dividing the desired final thickness of the tin layer at exit from the tinning line evenly among the tinning tanks of the line.

6. A method according to claim 1 wherein the speed of the strip in the tinning line is as far as possible maintained at a level such that the current in at least one tinning tank attains a maximum permitted value.

7. A method according to claim 2 wherein during tinning the said current deposition ratio r is increased or reduced as the actual thickness of the tin layer at exit of the strip from the line is greater or smaller respectively than the desired thickness at exit.

8. A method according to claim 2 wherein the thickness value of step (b) is determined by dividing the desired final thickness of the tin layer at exit from the tinning line evenly among the tinning tanks of the line.

9. A method according to claim 3 wherein the thickness value of step (b) is determined by dividing the desired final thickness of the tin layer at exit from the tinning line evenly among the tinning tanks of the line.

10. A method according to claim 2 wherein the speed of the strip in the tinning line is as far as possible maintained at a level such that the current in at least one tinning tank attains a maximum permitted value.

11. A method according to claim 3 wherein the speed of the strip in the tinning line is as far as possible maintained at a level such that the current in at least one tinning tank attains a maximum permitted value.

12. A method according to claim 4 wherein during tinning the said current deposition ratio r is increased or reduced as the actual thickness of the tin layer at exit of the strip from the line is greater or smaller respectively than the desired thickness at exit.

* * * * *